US009575461B2

(12) United States Patent
Akiyama et al.

(10) Patent No.: US 9,575,461 B2
(45) Date of Patent: Feb. 21, 2017

(54) PROCESS CARTRIDGE AND IMAGE FORMING METHOD USING TONER HAVING PROPERTIES FOR HIGH IMAGE QUALITY

(71) Applicant: CANON KABUSHIKI KAISHA, Tokyo (JP)

(72) Inventors: Hiroki Akiyama, Toride (JP); Koji Nishikawa, Susono (JP); Kosuke Fukudome, Tokyo (JP); Shotaro Nomura, Suntou-gun (JP); Daisuke Yoshiba, Suntou-gun (JP); Shohei Tsuda, Suntou-gun (JP); Katsuhisa Yamazaki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/819,671

(22) Filed: Aug. 6, 2015

(65) Prior Publication Data

US 2016/0041520 A1 Feb. 11, 2016

(30) Foreign Application Priority Data

Aug. 7, 2014 (JP) ..... 2014-161478

(51) Int. Cl.
*G03G 15/08* (2006.01)
*G03G 21/18* (2006.01)

(52) U.S. Cl.
CPC ..... *G03G 21/1814* (2013.01); *G03G 15/08* (2013.01)

(58) Field of Classification Search
CPC .. G03G 21/1814; G03G 9/825; G03G 9/9725; G03G 9/821
USPC ..... 399/254; 430/110.1, 108.1
See application file for complete search history.

(56) References Cited

U.S. PATENT DOCUMENTS

| | | | | |
|---|---|---|---|---|
| 6,859,633 | B2 * | 2/2005 | Handa | G03G 9/0821 399/119 |
| 7,801,469 | B2 * | 9/2010 | Uezono | G03G 15/0855 399/119 |
| 2001/0008594 | A1 * | 7/2001 | Takano | G03G 9/0821 399/263 |
| 2003/0016955 | A1 * | 1/2003 | Hiratsuka | G03G 15/0803 399/27 |

(Continued)

FOREIGN PATENT DOCUMENTS

| | | | |
|---|---|---|---|
| JP | 2004-118093 | A | 4/2004 |
| JP | 2006-350309 | A | 12/2006 |
| WO | 2013/063291 | A | 5/2013 |

OTHER PUBLICATIONS

Puri, "Characterizing Powder Flowability Using mathematical models and measurement methods" (Jan. 24, 2002).

*Primary Examiner* — Billy Lactaoen
*Assistant Examiner* — Arlene Heredia Ocasio
(74) *Attorney, Agent, or Firm* — Fitzpatrick, Cella, Harper & Scinto

(57) ABSTRACT

Provided is a process cartridge by which the stability of an image having a high print percentage can be obtained even when high-density loading is performed. The process cartridge is a process cartridge in which a toner having a uniaxial collapse stress at the time of a maximum consolidation stress of 10.0 kPa of 2.0 kPa or more and 4.5 kPa or less, and a total energy measured after its compression of 70 mJ or more and 95 mJ or less is stored in a toner container in a state in which the container has a loading density of 0.70 g/cm$^3$ or more.

10 Claims, 2 Drawing Sheets

(56) References Cited

U.S. PATENT DOCUMENTS

| | | | | |
|---|---|---|---|---|
| 2007/0065742 | A1* | 3/2007 | Ishizuka | G03G 9/0819 430/106.1 |
| 2007/0099102 | A1* | 5/2007 | Ieda | G03G 9/0819 430/108.1 |
| 2007/0122204 | A1* | 5/2007 | Kita | G03G 15/0874 399/258 |
| 2009/0047043 | A1* | 2/2009 | Dojo | G03G 9/0827 399/252 |
| 2016/0041483 | A1* | 2/2016 | Nishikawa | G03G 9/0835 430/110.3 |

* cited by examiner

PROCESS CARTRIDGE AND IMAGE FORMING METHOD USING TONER HAVING PROPERTIES FOR HIGH IMAGE QUALITY

BACKGROUND OF THE INVENTION

Field of the Invention

The present invention relates to a process cartridge and an image forming method in which the process cartridge is detachable.

Description of the Related Art

In a recent technological trend in an electrophotographic image forming apparatus, the apparatus has been required to have various characteristics such as an additionally high speed, high reliability over a long time period, a long lifetime, and a reduced space and a reduced power consumption in addition to high definition, high quality, and high image quality. In such electrophotographic method, a process cartridge being detachably mountable to the main body of the image forming apparatus has been frequently used.

While the process cartridge is increased in volume, a restriction on the size of the process cartridge is required from the viewpoints of a reduction in size of the apparatus and its space savings. Accordingly, in recent years, a direction toward achieving compatibility between the high reliability over a long time period, and the size reduction and the space savings by packing a toner, which is intended to be reduced in consumption through the control of its shape and chargeability, into the process cartridge at a high density has been required.

In view of the foregoing, an attempt has been made to achieve the high-density packed process cartridge.

Japanese Patent Application Laid-Open No. 2004-118093 provides an example in which a toner obtained by a polymerization method is loaded at a high density. However, the flowability of the toner is so high that air is included at the time of the loading and hence it takes a long time period to load the toner at a high density. In addition, when an image having a high print percentage is continuously output, a problem such as a reduction in image density occurs.

Japanese Patent Application Laid-Open No. 2006-350309 provides an example in which a toner obtained by a pulverization method is loaded at a high density. However, when the toner is loaded at an additionally high density, the toner is not stirred well and hence an image failure occurs. In particular, it has been difficult to achieve compatibility between the high-density packing of the toner into a process cartridge intended to have a larger volume and a longer lifetime, and stable developability in the toner that has been loaded at a high density.

SUMMARY OF THE INVENTION

The present invention is directed to providing a process cartridge and an image forming method by each of which the stability of an image having a high print percentage can be obtained even when high-density loading is performed.

Specifically, the present invention is directed to providing a process cartridge and an image forming method by each of which:

(i) a high image density is maintained even in a high-density packed toner container; and (ii) no image failure occurs even when sheets each having a pattern having a high print percentage are continuously passed.

According to one aspect of the present invention, there is provided a process cartridge, which is detachably mountable to a main body of an image forming apparatus, the process cartridge including:

an electrostatic image-bearing member;

a charging member for charging the electrostatic image-bearing member;

a toner container;

a toner stored in the toner container, and a developing device for developing an electrostatic image formed on a surface of the electrostatic image-bearing member with the toner, in which:

the toner container has arranged therein a member for stirring the toner;

the toner has a uniaxial collapse stress at a time of a maximum consolidation stress of 10.0 kPa of 2.0 kPa or more and 4.5 kPa or less, and is stored in the toner container in a state in which the container has a loading density of 0.70 g/cm$^3$ or more; and in a test involving vertically entering a rotating blade into a toner layer formed by compressing the toner, a total energy which is a total sum of a rotational torque of the blade and a vertical load needed for vertically entering the blade, is 70 mJ or more and 95 mJ or less.

According to another aspect of the present invention, there is provided an image forming method, including:

forming an electrostatic image on a charged electrostatic image-bearing member;

developing the electrostatic image with a toner to form a toner image;

transferring the toner image onto a transfer material through or without through an intermediate transfer member; and fixing the toner image on the transfer material with a fixing device, in which:

the toner to be used in the development is stored in a toner container, and the toner container has a member for stirring the toner therein;

the toner has a uniaxial collapse stress at a time of a maximum consolidation stress of 10.0 kPa of 2.0 kPa or more and 4.5 kPa or less, and is stored in the toner container in a state in which the container has a loading density of 0.70 g/cm$^3$ or more; and in a test involving vertically entering a rotating blade into a toner layer formed by compressing the toner, a total energy which is a total sum of a rotational torque of the blade and a vertical load needed for vertically entering the blade, is 70 mJ or more and 95 mJ or less.

According to the present invention, it is possible to provide the process cartridge and the image forming method by each of which: a high image density is maintained even when the loading density of a toner container is high; and no image failure occurs even when continuous sheet passing is performed.

Further features of the present invention will become apparent from the following description of exemplary embodiments with reference to the attached drawings.

DESCRIPTION OF THE EMBODIMENTS

Figure 1:
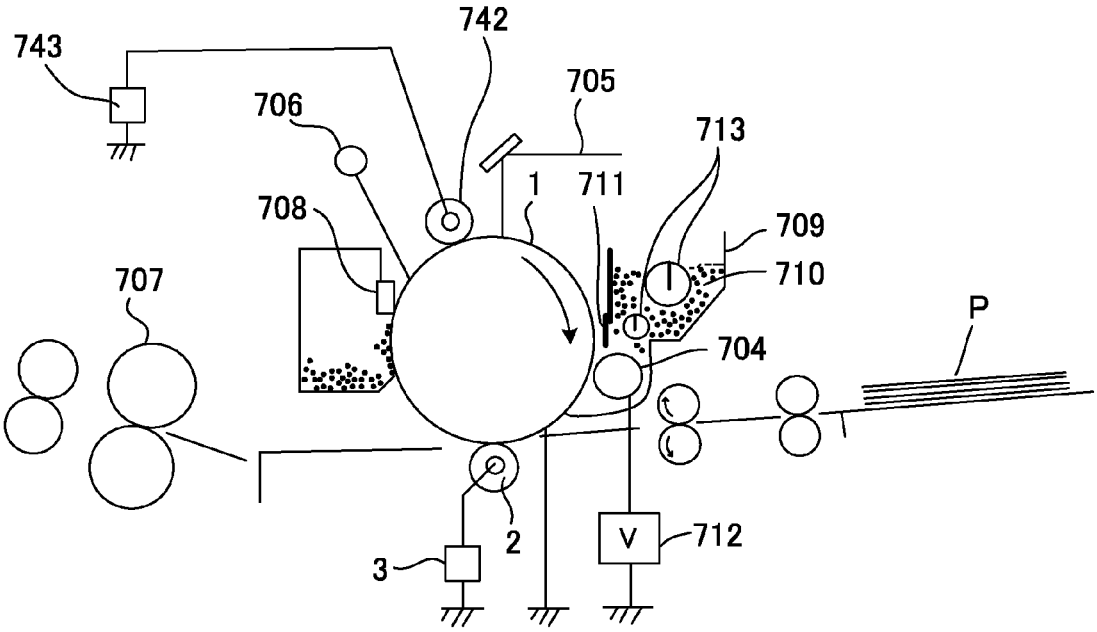
FIG. 1 is a schematic view for illustrating an example of a suitable image forming apparatus.

Preferred embodiments of the present invention will now be described in detail in accordance with the accompanying drawings.

According to investigations made by the inventors of the present invention, the use of a process cartridge of the present invention and an image forming method in which the process cartridge is detachable enables the use of a high-density packed process cartridge. In addition, a high image density is maintained even in the high-density packed process cartridge, and an image having no image failure can be obtained even when sheets each having an image having a high print percentage are continuously passed.

Loading a toner having high flowability provides excellent developability and an excellent stirring property in a toner container. However, a sufficient amount of the toner is not supplied to a developing portion in a system using a high-density packed toner container, and hence it has been difficult to maintain an image density in an image having a high print percentage.

In addition, a toner having low flowability is not sufficiently stirred in the high-density packed toner container, and hence an image failure has occurred. As described above, it has been difficult to achieve compatibility between high-density loading and image quality through the control of the flowability of the toner.

As an indicator that replaces the conventional flowability, the inventors of the present invention have investigated in detail the physical properties of a toner in a loaded state, and their influences on its stirring property in a toner container and its developability.

As a result, the inventors have found the following. The conventional toner excellent in flowability has a small adhesive force between toner particles. Accordingly, air is included at the time of its loading and a volume occupied by the air in a toner container increases, whereby the loading property of the toner becomes poor.

In addition, the inventors have found that the adhesive force between the toner particles is small, and hence the amount of the toner to be supplied to a developing portion cannot be maintained at a sufficient level and an image density reduces. In addition, the inventors have found that a toner having low flowability is not sufficiently shredded after its packing, which is responsible for an image failure.

That is, the inventors have found that high-density packing requires the following physical properties: an adhesive force between toner particles is high and a toner easily loosens.

As a result of their investigations, the inventors have reached the conclusion that particularly when such high-density loading that a loading density is 0.70 g/cm$^3$ or more is performed by performing tapping or consolidation loading, it is optimum that a uniaxial collapse stress and a total energy fall within certain ranges. Such conditions are suitable particularly when such a high density that the ratio of a volume occupied by the toner to the volume of a toner container exceeds 35% is achieved.

Here, the uniaxial collapse stress means the adhesive force between the toner particles, and as the uniaxial collapse stress increases, the adhesive force between the toner particles increases. When the adhesive force between the toner particles increases, a distance between the toner particles shortens upon loading of the toner, and hence air is hardly included. Accordingly, its loading property improves.

In addition, when the uniaxial collapse stress increases, the density of the toner to be conveyed to the developing portion increases, and hence a developing density is maintained when sheets each having an image having a high print percentage are continuously passed.

The total energy means the ease with which the toner loosens itself from its consolidated state, and as the total energy reduces, the toner loosens itself from the consolidated state more easily and is more excellent in stirring property.

Specifically, it is important that in a toner container having a stirring member and a loading density of 0.70 g/cm$^3$ or more, the uniaxial collapse stress of the toner at the time of a maximum consolidation stress of 10.0 kPa be 2.0 kPa or more and 4.5 kPa or less. When the uniaxial collapse stress is less than 2.0 kPa, the adhesive force between the toner particles is weak, and hence the toner cannot be present at a high density in the developing portion and an image density reduces. When the uniaxial collapse stress is more than 4.5 kPa, the adhesive force between the toner particles is large, and hence it becomes difficult to shred the toner and a stable image density cannot be obtained.

In addition, it is important that in a test involving vertically entering a rotating blade into a toner layer formed by compressing the toner, the total energy as the total of the rotational torque of the blade and a vertical load needed for vertically entering the blade be 70 mJ or more and 95 mJ or less. In the case where the total energy is less than 70 mJ, a torque is hardly applied at the time of the stirring of the toner and the conveyability of the toner reduces, and hence the image density reduces when sheets each having an image having a high print percentage are continuously passed. In the case where the total energy is more than 95 mJ, the stirring becomes difficult when the toner is loaded at a high density.

As described above, simultaneous control of the uniaxial collapse stress and the total energy is important for obtaining image quality upon high-density loading.

In order that the above-mentioned physical properties may be obtained, the average circularity of the toner is preferably 0.930 or more and 0.970 or less. When the average circularity of the toner falls within the range, an area of contact between the toner particles becomes moderate and the adhesive force between the toner particles falls within an additionally suitable range.

In addition, the toner preferably contains organic-inorganic composite fine particles as an external additive. This is because the presence of an organic portion increases the adhesive force between the toner particles and the presence of an inorganic particle reduces the total energy to facilitate the loosening of the toner.

Further, of the organic-inorganic composite fine particles, the following structure is preferred: a plurality of protrusions derived from inorganic fine particles are present on the surface of each of the organic-inorganic composite fine particles. As such organic-inorganic composite fine particles, there are given those having a structure in which the inorganic fine particles are buried in resin particles so that the plurality of protrusions derived from the inorganic particles are present.

The presence of such structure increases an area of contact between each of the organic-inorganic composite fine particles and the toner, increases the adhesive force between the toner particles, and increases the uniaxial collapse stress. Accordingly, the loading property improves, and hence the image density can be maintained when sheets each having an image having a high print percentage are continuously passed.

With regard to an indicator representing the structure, a SF-2 representing a shape is preferably 103 or more and 120 or less. In order that the above-mentioned shape may be obtained, the probability that the inorganic fine particles are present on the surfaces of the organic-inorganic composite fine particles is preferably 20 area % or more and 70 area % or less.

In addition, the number-average particle diameter (D1) of the primary particles of the organic-inorganic composite fine particles is preferably 50 nm or more and 500 nm or less. Their addition amount is preferably from 0.3 part by mass to 4.0 parts by mass with respect to 100 parts by mass of the toner base particles.

The organic-inorganic composite fine particles can be produced in accordance with, for example, the description of Examples of International Publication No. WO2013/063291, but the production method is not limited thereto.

In addition, in the present invention, strontium titanate is preferably used in combination with the composite fine particles because the adhesive force between the toner particles is increased and the loading property is improved.

That is also because of the following reason. In particular, when the toner base particles are negatively chargeable, strontium titanate is charged to the polarity opposite to that of the toner base particles to serve to electrostatically increase the adhesive force between the toner particles.

An external additive having positive chargeability such as titanium oxide or a melamine resin can also be used instead of strontium titanate. However, strontium titanate is preferred because its particle diameter is easily controlled, and strontium titanate contributes to the adhesive force between the toner particles to a larger extent and exhibits an effect on the loading property. The number-average particle diameter (D1) of the primary particles of strontium titanate is preferably 500 nm or more and 2 μm or less.

A method of producing strontium titanate fine particles is not particularly limited, but the fine particles are produced by, for example, the following method.

A general method of producing the strontium titanate fine particles is, for example, a method involving subjecting titanium oxide and strontium carbonate to a solid phase reaction, and then sintering the resultant. A known reaction to be adopted in the production method can be represented by the following formula.

$$TiO_2+SrCO_3 \rightarrow SrTiO_3+CO_2$$

That is, the fine particles are produced by: washing and drying a mixture containing titanium oxide and strontium carbonate; sintering the dried product; mechanically pulverizing the sintered product; and classifying the pulverized product. At this time, composite inorganic fine powder containing strontium titanate, strontium carbonate, and titanium oxide can be obtained by adjusting raw materials and sintering conditions.

Strontium carbonate as a raw material is not particularly limited as long as the substance has $SrCO_3$ composition, and any one of the commercial products can be used. In addition, titanium oxide as a raw material is not particularly limited as long as the substance has $TiO_2$ composition. Examples of the titanium oxide include metatitanic acid slurry (undried hydrated titanium oxide) obtained by a sulfuric acid method and titanium oxide powder. The sintering is performed at a temperature of preferably from 500° C. to 1,300° C., more preferably from 650° C. to 1,100° C.

When the sintering temperature is higher than 1,300° C., secondary agglomeration between the particles due to the sintering is liable to occur, and hence a load on the pulverizing step enlarges. In addition, when the sintering temperature is lower than 600° C., a large amount of an unreacted component remains and hence it becomes difficult to stably produce the strontium titanate fine particles. In addition, a sintering time is preferably from 0.5 hour to 16 hours, more preferably from 1 hour to 5 hours.

When the sintering time is longer than 16 hours, as in the foregoing, all amounts of strontium carbonate and titanium oxide react with each other, and hence strontium titanate particles to be obtained undergo secondary agglomeration in some cases. When the sintering time is shorter than 0.5 hour, a large amount of an unreacted component remains and hence it becomes difficult to stably produce the strontium titanate fine particles.

On the other hand, available as a method of producing the strontium titanate fine particles that does not include any sintering step is a method involving adding the hydroxide of strontium to a dispersion liquid of titania sol, which is obtained by adjusting the pH of hydrated titanium oxide slurry obtained by hydrolyzing an aqueous solution of titanyl sulfate, and warming the mixture to a reaction temperature to synthesize the fine particles.

Titania sol having a good crystallinity and a good particle diameter is obtained by setting the pH of the hydrated titanium oxide slurry to from 0.5 to 1.0. In addition, an alkaline substance such as sodium hydroxide is preferably added to the dispersion liquid of titania sol for the purpose of removing an ion adsorbing to a titania sol particle.

At this time, in order that a sodium ion or the like may not be caused to adsorb to the surface of hydrated titanium oxide, it is preferred that the pH of the slurry be not set to 7 or more. In addition, the reaction temperature is preferably from 60° C. to 100° C., and in order that a desired particle size distribution may be obtained, a rate of temperature increase is preferably set to 30° C./hr or less and a reaction time is preferably from 3 hours to 7 hours.

The following method is available as a method of subjecting the strontium titanate fine particles produced by such method as described above to a surface treatment with a fatty acid or a metal salt thereof. For example, a fatty acid can be precipitated on the surface of a perovskite-type crystal by loading strontium titanate fine particle slurry into an aqueous solution of a fatty acid sodium under an Ar gas or $N_2$ gas atmosphere.

In addition, a fatty acid metal salt can be precipitated on, and caused to adsorb to, the surface of the perovskite-type crystal by loading the strontium titanate fine particle slurry into the aqueous solution of the fatty acid sodium under an Ar gas or $N_2$ gas atmosphere, and dropping a desired aqueous solution of a metal salt to the mixture while stirring the mixture. For example, aluminum stearate can be caused to adsorb to the surface by using an aqueous solution of sodium stearate and aluminum sulfate.

A binder resin to be used for the toner base particles of the present invention is described.

Examples of the binder resin include a polyester-based resin, a vinyl-based resin, an epoxy resin, and a polyurethane resin. The binder resin is not particularly limited thereto, and a hitherto known resin can be used. Of those, a polyester resin or a vinyl-based resin, or a hybrid resin containing both the resins is preferably incorporated from the viewpoint of achievement of both chargeability and fixability.

The composition of the polyester resin is as described below.

A monomer for the polyester may contain an aromatic diol as a dihydric alcohol component.

Examples of the aromatic diol include a bisphenol represented by the following formula [2] and a derivative thereof, and diols each represented by the following formula [3].

Formula [2]

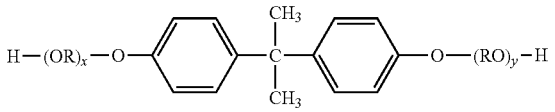

(In the formula, R represents an ethylene or propylene group, x and y each represent an integer of 1 or more, and the average of x+y is from 2 to 10.)

Formula [3]

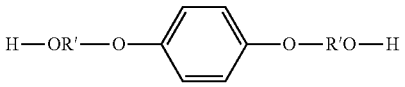

(In the formula, R' represents

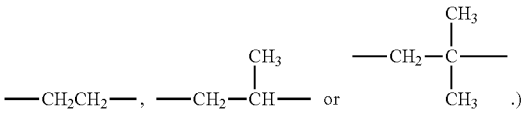

A linear aliphatic diol may be contained as the dihydric alcohol component.

As a divalent acid component, for example, there are given dicarboxylic acids and derivatives thereof such as: benzene dicarboxylic acids or anhydrides thereof such as phthalic acid, terephthalic acid, isophthalic acid, and phthalic anhydride, or lower alkyl esters thereof; alkyldicarboxylic acids or anhydrides thereof such as succinic acid, adipic acid, sebacic acid, and azelaic acid, or lower alkyl esters thereof; alkenylsuccinic acids or alkylsuccinic acids or anhydrides thereof such as n-dodecenylsuccinic acid and n-dodecylsuccinic acid, or lower alkyl esters thereof; and unsaturated dicarboxylic acids or anhydrides thereof such as fumaric acid, maleic acid, citraconic acid, and itaconic acid, or lower alkyl esters thereof.

In addition, an alcohol component that is trihydric or more and an acid component that is trivalent or more, the components serving as crosslinking components, may each be used alone, or may be used in combination.

The polyester resin is typically obtained by condensation polymerization that has been generally known.

On the other hand, for example, the following monomers are given as a vinyl-based monomer for producing the vinyl-based resin.

As a styrene-based monomer, there are given, for example, styrene derivatives such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene.

As an acrylic acid-based monomer, there are given, for example: acrylic acid and acrylic acid esters such as acrylic acid, methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; α-methylene aliphatic monocarboxylic acids and esters thereof such as methacrylic acid, methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and acrylic acid or methacrylic acid derivatives such as acrylonitrile, methacrylonitrile, and acrylamide.

Further, as a monomer for a vinyl-based polymer unit, there are given, for example, monomers each having a hydroxyl group such as: acrylic acid or methacrylic acid esters, e.g., 2-hydroxylethyl acrylate, 2-hydroxylethyl methacrylate, and 2-hydroxylpropyl methacrylate; 4-(1-hydroxy-1-methylbutyl)styrene; and 4-(1-hydroxy-1-methylhexyl) styrene.

Various monomers that can be subjected to vinyl polymerization may be used in combination for the vinyl-based polymer unit as required.

In addition, the vinyl-based polymer unit may be a polymer that is crosslinked with a crosslinkable monomer as required. Examples of the crosslinkable monomer include an aromatic divinyl compound, a diacrylate compound linked through an alkyl chain, a diacrylate compound linked through an alkyl chain containing an ether bond, a diacrylate compound linked through a chain containing an aromatic group and an ether bond, a polyester-type diacrylate, and a polyfunctional crosslinking agent.

The vinyl-based polymer unit may be a resin produced by using a polymerization initiator.

The hybrid resin is a resin in which a polyester unit and the vinyl-based polymer unit are chemically bonded to each other. Thus, a compound capable of reacting with the monomers for both of the resins (hereinafter referred to as "bireactive compound") is used for polymerization. Examples of such bireactive compound include fumaric acid, acrylic acid, methacrylic acid, citraconic acid, maleic acid, and dimethyl fumarate. Of those, fumaric acid, acrylic acid, and methacrylic acid are preferably used.

The hybrid resin can be obtained by a method involving simultaneously or sequentially subjecting a raw material monomer for the polyester unit and a raw material monomer for the vinyl-based polymer unit to a reaction.

Such hybrid resin as described above may be used alone as the binder resin, but a resin having a different molecular weight can be further added.

The toner of the present invention may further contain a magnetic material or a colorant.

Examples of the magnetic material can include the following materials.

There are given: iron oxides such as magnetite, hematite, and ferrite; and metals such as iron, cobalt, and nickel, and alloys and mixtures of these metals with metals such as aluminum, cobalt, copper, lead, magnesium, tin, zinc, antimony, bismuth, calcium, manganese, titanium, tungsten, and vanadium.

The toner of the present invention may also contain a wax.

Examples of the wax to be used in the present invention include the following: aliphatic hydrocarbon-based waxes such as low-molecular-weight polyethylene, low-molecular-weight polypropylene, a polyolefin copolymer, a polyolefin wax, a microcrystalline wax, a paraffin wax, and a Fischer-Tropsch wax; oxides of aliphatic hydrocarbon-based waxes such as a polyethylene oxide wax; or block copolymers thereof; plant-based waxes such as a candelila wax, a carnauba wax, a haze wax, and a jojoba wax; animal-based waxes such as a bees wax, lanolin, and a spermaceti wax; mineral-based waxes such as ozokerite, ceresin, and petrolatum; waxes containing aliphatic esters as main components such as a montanic acid ester wax and a castor wax; and partially or wholly deacidified aliphatic esters such as a deacidified carnauba wax.

The examples further include: saturated linear fatty acids such as palmitic acid, stearic acid, montanic acid, and a long-chain alkylcarboxylic acid having an additionally long alkyl group; unsaturated fatty acids such as brassidic acid, eleostearic acid, and parinaric acid; saturated alcohols such as stearyl alcohol, eicosyl alcohol, behenyl alcohol, carnaubyl alcohol, ceryl alcohol, melissyl alcohol, and an alkyl alcohol having an additionally long alkyl group; polyhydric alcohols such as sorbitol; aliphatic amides such as linoleic amide, oleic amide, and lauric amide; saturated aliphatic bis amides such as methylene bis stearamide, ethylene bis capramide, ethylene bis lauramide, and hexamethylene bis stearamide; unsaturated fatty acid amides such as ethylene bis oleamide, hexamethylene bis oleamide, N,N'-dioleyl adipamide, and N,N'-dioleyl sebacamide; aromatic bis amides such as m-xylene bis stearamide and N,N'-distearyl isophthalamide; aliphatic metal salts (which are generally referred to as metallic soaps) such as calcium stearate, calcium laurate, zinc stearate, and magnesium stearate; waxes obtained by grafting aliphatic hydrocarbon-based waxes with vinyl-based monomers such as styrene and acrylic acid; partially esterified products of fatty acids and polyhydric alcohols such as behenic monoglyceride; and methyl ester compounds each having a hydroxyl group obtained by the hydrogenation of vegetable oils and fats.

In addition, the waxes whose molecular weight distribution is sharpened by a press sweating method, a solvent method, a recrystallization method, a vacuum distillation method, a supercritical gas extraction method, or a melt crystallization method are preferably used. In addition, waxes from which a low-molecular-weight solid fatty acid, a low-molecular-weight solid alcohol, a low-molecular-weight solid compound, or other impurities are removed are also preferably used.

Specific examples of the waxes that may be used as release agents include: Biscol (trademark) 330-P, 550-P, 660-P, and TS-200 (Sanyo Chemical Industries, Ltd.); Hiwax 400P, 200P, 100P, 410P, 420P, 320P, 220P, 210P, and 110P (Mitsui Chemicals, Inc.); Sasol H1, H2, C80, C105, and C77 (Schumann Sasol); HNP-1, HNP-3, HNP-9, HNP-10, HNP-11, and HNP-12 (Nippon Seiro Co., Ltd.); Unilin (trademark) 350, 425, 550, and 700 and Unisid (trademark) 350, 425, 550, and 700 (Toyo-Petrolite); and a haze wax, a beeswax, a rice wax, a candelilla wax, and a carnauba wax (available from Cerarica Noda Co., Ltd.).

In the toner of the present invention, a charge control agent is preferably used in order to stabilize its chargeability. An organometallic complex or a chelate compound, whose central metal can easily interact with an acid group or a hydroxyl group present in a terminal of the binder resin to be used in the present invention, is effective as the charge control agent. Examples thereof include: a monoazo metal complex; an acetylacetone metal complex; and a metal complex or metal salt of an aromatic hydroxycarboxylic acid or an aromatic dicarboxylic acid.

Specific examples of the charge control agent that may be used include Spilon Black TRH, T-77, T-95 (manufactured by Hodogaya Chemical Co., Ltd.), and BONTRON (trademark) S-34, S-44, S-54, E-84, E-88, E-89 (manufactured by Orient Chemical Industries Co., Ltd.). In addition, a charge control resin can also be used together with the above-mentioned charge control agents.

A method of producing the toner base particles according to the present invention is not particularly limited, and for example, a known production method such as a pulverization method, a suspension polymerization method, a dissolution suspension method, an emulsion aggregation method, or a dispersion polymerization method can be used. From the viewpoint of controlling a shape, it is preferred that the toner base particles be produced by a pulverization method.

When the toner base particles are produced by the pulverization method, toner base particles according to the present invention can be obtained by:

(i) sufficiently mixing, for example, the binder resin and magnetic iron oxide particles as the colorant constituting the toner base particles, and as required, the wax and other additives with a mixer such as a Henschel mixer or a ball mill;

(ii) melting and kneading the resultant mixture with a heat kneader such as a biaxial kneading extruder, a heating roll, a kneader, or an extruder to make resins compatible with each other, followed by the dispersion or dissolution of the wax, the magnetic iron oxide particles, and a metal-containing compound in the resultant;

(iii) cooling and solidifying the resultant, followed by the pulverization of the solidified product; and (iv) classifying the pulverized product.

In addition, in order that the shapes and surface properties of the toner base particles may be controlled, the method preferably includes, after the pulverization or the classification, a surface treatment step of passing the resultant through the inside of a surface treatment apparatus that continuously applies a mechanical impact force. The surface shape of the toner can be controlled by controlling a treatment time for the surface treatment step.

Further, as required, a desired external additive is sufficiently mixed with a mixer such as a Henschel mixer. Thus, the toner according to the present invention can be obtained.

Examples of the mixer include: Henschel mixer (manufactured by Nippon Coke & Engineering Co., Ltd.); Super Mixer (manufactured by Kawata Mfg Co., Ltd.); Ribocone (manufactured by Okawara Corporation); Nauta Mixer, Turburizer, and Cyclomix (manufactured by Hosokawa Micron); Spiral Pin Mixer (manufactured by Pacific Machinery & Engineering Co., Ltd.); and Loedige Mixer (manufactured by Matsubo Corporation).

Examples of the kneader include: KRC kneader (manufactured by Kurimoto Ironworks Co., Ltd.); Buss Co-kneader (manufactured by Buss Co., Ltd.), TEM-type extruder (manufactured by Toshiba Machine Co., Ltd.); TEX Biaxial Kneader (manufactured by The Japan Steel Works, Ltd.); PCM Kneader (manufactured by Ikegai machinery Co.); Three-Roll Mill, Mixing Roll Mill, and Kneader (manufactured by Inoue Manufacturing Co., Ltd.); Kneadex (manufactured by Mitsui Mining Co., Ltd.); MS-type Pressure Kneader, and Kneader-Ruder (manufactured by Moriyama Manufacturing Co., Ltd.); and Banbury Mixer (manufactured by Kobe Steel, Ltd.).

Examples of the pulverizer include: Counter Jet Mill, Micron Jet, and Inomizer (manufactured by Hosokawa Micron); IDS-type Mill and PJM Jet Mill (manufactured by Nippon Pneumatic MFG Co., Ltd.); Cross Jet Mill (manufactured by Kurimoto Tekkosho KK); Ulmax (manufactured by Nisso Engineering Co., Ltd.); SK Jet O-Mill (manufactured by Seishin Enterprise Co., Ltd.); Criptron (manufactured by Kawasaki Heavy Industries, Ltd.); Turbo Mill (manufactured by Turbo Kogyo Co., Ltd.); and Super Rotor (manufactured by Nisshin Engineering Inc.).

Examples of the classifier include: Classiel, Micron Classifier, and Spedic Classifier (manufactured by Seishin Enterprise Co., Ltd.); Turbo Classifier (manufactured by Nisshin Engineering Inc.); Micron Separator, Turboprex (ATP), and TSP Separator (manufactured by Hosokawa Micron); Elbow Jet (manufactured by Nittetsu Mining Co., Ltd.); Dispersion Separator (manufactured by Nippon Pneumatic MFG Co., Ltd.); and YM Microcut (manufactured by Yasukawa Shoji K.K.).

Examples of the surface-modifying apparatus include Faculty (manufactured by Hosokawa Micron), Mechanofusion (manufactured by Hosokawa Micron), Nobilta (manufactured by Hosokawa Micron), Hybridizer (manufactured by Nara Machinery Co., Ltd.), Inomizer (manufactured by Hosokawa Micron), Theta Composer (manufactured by Tokuju Corporation), and MECHANOMILL (manufactured by Okada Seiko Co., Ltd.).

As a sifter for sieving coarse particles, there are given: Ultra Sonic (manufactured by Koei Sangyo Co., Ltd.); Rezona Sieve and Gyro Sifter (manufactured by Tokuju Corporation); Vibrasonic System (manufactured by Dalton Co., Ltd.); Sonicreen (manufactured by Shinto Kogyo K.K.); Turbo Screener (manufactured by Turbo Kogyo Co., Ltd.); Microsifter (manufactured by Makino Mfg. Co., Ltd.); and circular vibrating sieves.

The toner of the present invention preferably contains an external additive other than the organic-inorganic composite fine particles.

Examples of the other external additive include: fluorine-based resin powder such as vinylidene fluoride fine powder or polytetrafluoroethylene fine powder; fine powder silica such as wet silica or dry silica, fine powder titanium oxide, fine powder alumina, and treated silica obtained by subjecting the fine powder to a surface treatment with a silane compound, a titanium coupling agent, or silicone oil; oxides such as zinc oxide and tin oxide; complex oxides such as strontium titanate, barium titanate, calcium titanate, strontium zirconate, and calcium zirconate; and carbonate compounds such as calcium carbonate and magnesium carbonate.

The other external additive is preferably fine powder produced by the vapor phase oxidation of a silicon halide, i.e., the so-called dry silica or fumed silica. The silica is produced by utilizing, for example, a pyrolysis oxidation reaction in the oxyhydrogen flame of a silicon tetrachloride gas, and a reaction formula that provides a basis for the reaction is as described below.

$$SiCl_4+2H_2+O_2 \rightarrow SiO_2+4HCl$$

In the production process, composite fine powder of the silica and any other metal oxide can be obtained by using any other metal halide such as aluminum chloride or titanium chloride together with the silicon halide, and is also included in the category of the silica.

The number-average particle diameter of the primary particles of the fine powder in a particle size distribution on a number basis is preferably 5 nm or more and 30 nm or less because high chargeability and high flowability can be imparted to the toner.

The following may be given as commercial silica fine powders each produced by the vapor phase oxidation of a silicon halide: silica fine powders commercially available under trade names of AEROSIL 130, 200, 300, 380, TT 600, MOX 170, MOX 80, COK 84 (each of which is manufactured by Nippon Aerosil Co., Ltd.), Ca—O—SiLM-5, MS-7, MS-75, HS-5, EH-5 (each of which is manufactured by CABOT Co.), Wacker HDK N 20, V15, N20E, T30, T40 (each of which is manufactured by WACKER-CHEMIE GMBH), D-C Fine Silica (manufactured by Dow Corning Corporation), and Fransol (Fransil). These silica fine powders may also be suitably used in the present invention.

Next, an example of the image forming method of the present invention is described with reference to FIG. 1.

The surface of a photosensitive drum 1 is charged to negative polarity by a primary charging unit 742, and a digital latent image is formed on the surface by image scanning through exposure 705 based on laser light.

The latent image is subjected to reversal development with a one-component magnetic developer 710 of a developing unit 709 including a magnetic blade 711 and a developing sleeve (developer carrier) 704 including a magnet.

In a developing portion, the conductive substrate of the photosensitive drum 1 is grounded, and an alternate bias, a pulse bias, and/or a DC bias are each/is applied to the developing sleeve 704 by a bias-applying device 712. When transfer paper (a transfer material) P is conveyed to reach a transferring portion, the transfer paper P is charged by a voltage-applying device 8 in a roller transferring device 2 from its back surface (surface opposite to the photosensitive drum side). Thus, the developed image (toner image) on the surface of the photosensitive drum 1 is transferred onto the transfer paper (in FIG. 1, no intermediate transfer member is present). The transfer paper P separated from the photosensitive drum 1 is subjected to a fixation treatment by a heating-pressurizing roller fixing unit 707 in order that the toner image on the transfer paper P may be fixed.

The one-component developer remaining on the photosensitive drum 1 after the transferring step is removed by a cleaning device 708 having a cleaning blade. Electricity is removed from the photosensitive drum 1 after the cleaning by erase exposure 706, and steps starting from the charging step with the primary charging unit 742 are repeated again.

The photosensitive drum (i.e., electrostatic image-bearing member) 1 has a photosensitive layer and the conductive substrate, and moves in a direction indicated by an arrow. The nonmagnetic and cylindrical developing sleeve 704 as a toner carrier rotates so as to move in the same direction as that of the surface of the photosensitive drum 1 in the developing portion. A multipolar permanent magnet (magnet roll) as a magnetic field-generating device is placed in the developing sleeve 704 so as not to rotate.

The one-component insulative magnetic developer 710 in the developing unit 709 is applied onto the nonmagnetic cylindrical surface, and magnetic toner particles are each provided with, for example, negative triboelectric charge by friction between the surface of the developing sleeve 704 and the magnetic toner particle.

Further, the magnetic blade 711 is placed so as to be close to the cylindrical surface (interval: 50 μm to 500 μm) and to be opposite to one magnetic pole position of the multipolar permanent magnet, whereby the thickness of a developer layer is regulated to be small (30 μm to 300 μm) and uniform. Thus, a developer layer thinner than a gap between the photosensitive drum 1 and the developing sleeve 704 in the developing portion is formed.

The speed of the surface of the sleeve is made substantially equal, or close, to the speed of the surface of the photosensitive drum by adjusting the rotational speed of the developing sleeve 704. An opposing magnetic pole may be formed by using a permanent magnet as the magnetic blade 711 instead of iron. In the developing portion, an AC bias or a pulse bias may be applied to the developing sleeve 704 by the bias-applying device 712. The AC bias only needs to have a frequency f of from 200 Hz to 4,000 Hz and a peak-to-peak voltage Vpp of from 500 V to 3,000 V.

Upon movement of the magnetic toner particles in the developing portion, the magnetic toner particles move toward an electrostatic image by virtue of the actions of the electrostatic force of the surface of the photosensitive drum and the AC bias or the pulse bias.

The developer may be applied onto the developing sleeve while the thickness of the developer layer is regulated by a pressing force through the use of an elastic blade formed of an elastic material such as a silicone rubber instead of the magnetic blade 711. Reference numeral 3 represents a constant-voltage source, reference numeral 713 represents a stirring mechanism and reference numeral 743 represents a bias-applying apparatus.

Figure 2:
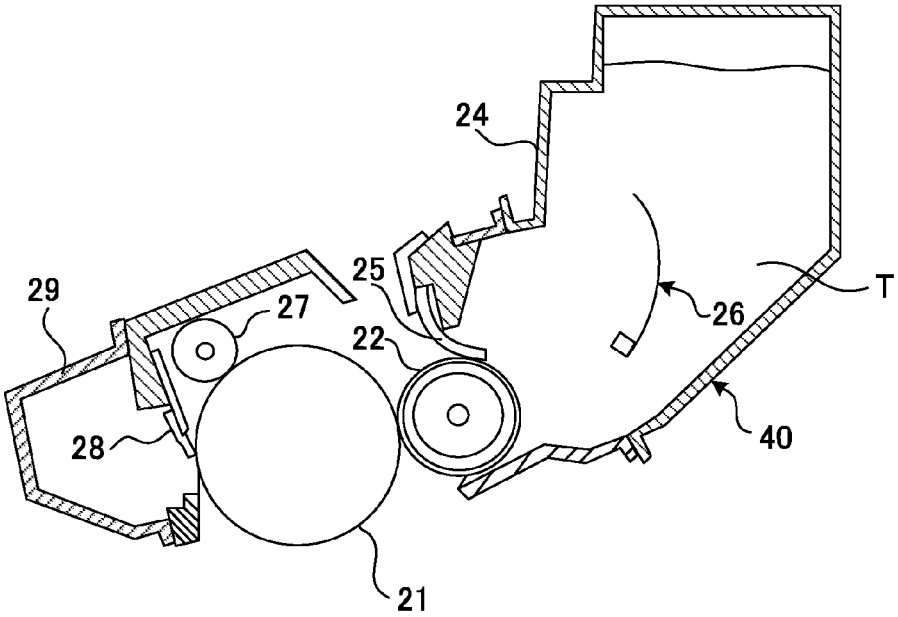
FIG. 2 is a schematic view for illustrating an example of a suitable process cartridge.

FIG. 2 is an illustration of a specific example of a process cartridge being detachably mountable to the main body of an image forming apparatus, the process cartridge being used in this example.

In the process cartridge, an electrophotographic photosensitive member (photosensitive member) 21 as an electrostatic image-bearing member, a charging device (charging member) 27 for uniformly charging the photosensitive member 21, a developer container (toner container) 24 as a portion for storing a developer (toner) T coupled with a developing roller 22 as a developer carrier and a toner-regulating member 25, the container serving as a developing apparatus 40 as a developing device placed so as to be out of contact with, and opposite to, the photosensitive member 21, a stirring member 26 for stirring the toner in the toner container 24, the stirring member being placed in the toner container 24, a cleaning device 28, and a waste toner container 29 for storing a waste toner removed from the photosensitive member 21 by the cleaning device 28 are integrally constituted.

<Uniaxial Collapse Stress Measurement Method>

The uniaxial collapse stress is measured with ShearScan TS-12 (manufactured by Sci-Tec Inc.), and the measurement with ShearScan is carried out in accordance with a principle based on a Mohr-Coulomb model described in "CHARACTERIZING POWDER FLOWABILITY" (published on 2002 Jan. 24)" written by Prof. Virendra M. Puri.

Specifically, the measurement was performed with a linear shear cell (columnar, diameter: 80 mm, volume: 140 $cm^3$) capable of linearly applying a shear force in a sectional direction in a room-temperature environment (23° C., 60% RH). A toner is loaded into the cell, a vertical load is applied so as to have a value of 2.5 kPa, and a consolidated powder layer is produced so as to be in the closest-packed state at the vertical load. Similarly, consolidated powder layers are formed by changing the vertical load to 5.0 kPa and 10.0 kPa. Then, a stationary point is determined by performing the following test: while the vertical load applied upon formation of the consolidated powder layer is continuously applied to the sample formed at each of the vertical loads, a shear force is gradually applied thereto and a fluctuation in shear stress at that time is measured. Whether the consolidated powder layer has reached the stationary point is judged as follows: in the test, when the displacement of the shear stress and the displacement of a load-applying device for applying a vertical load in a vertical direction become small, and both the displacements start to take stable values, the consolidated powder layer is judged to have reached the stationary point. Next, the vertical load is gradually removed from the consolidated powder layer that has reached the stationary point, a fracture envelope (vertical load stress vs. shear stress plot) at each load is created, and its Y intercept and slope are determined. In analysis based on the Mohr-Coulomb model, the uniaxial collapse stress and the maximum consolidation stress are represented by the following equations, and the Y intercept represents a "cohesive force" and the slope represents an "internal friction angle."

$$\text{Uniaxial collapse stress}=2c(1+\sin\phi)/\cos\phi$$

$$\text{Maximum consolidation stress}=((A-(A^2\sin^2\phi-\tau_{ssp}^2\cos^2\phi)^{0.5})/\cos^2\phi)\times(1+\sin\phi)-(c/\tan\phi)$$

($A=\sigma_{ssp}+(c/\tan\phi)$, c=cohesive force, $\phi$=internal friction angle, $\tau_{ssp}=c+\sigma_{ssp}\times\tan\phi$, $\sigma_{ssp}$=vertical load at stationary point)

The uniaxial collapse stress and the maximum consolidation stress that have been calculated at each load are plotted (flow function plot), and a straight line is drawn based on the plot. A uniaxial collapse stress at the time of a maximum consolidation stress of 10.0 kPa is determined from the straight line.

<Method of Measuring Total Energy>

Measurement is performed with a powder flowability analyzer including a rotary propeller-type blade (Powder Rheometer FT-4, manufactured by Freeman Technology) (hereinafter abbreviated as "FT-4").

Figure 3A:
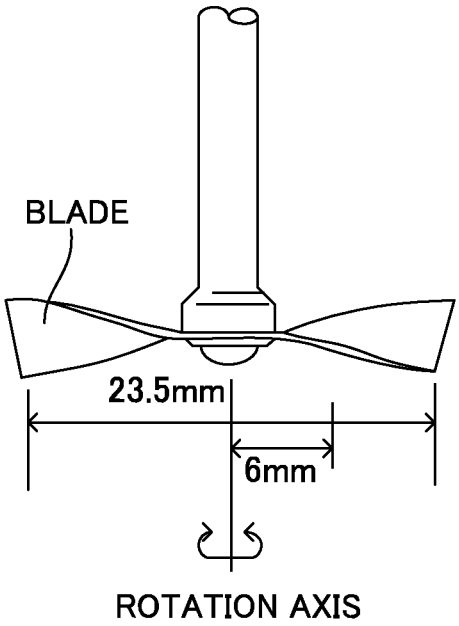
FIG. 3A and FIG. 3B are views for illustrating a propeller-type blade to be used in the measurement of a shear load value.
Figure 3B:
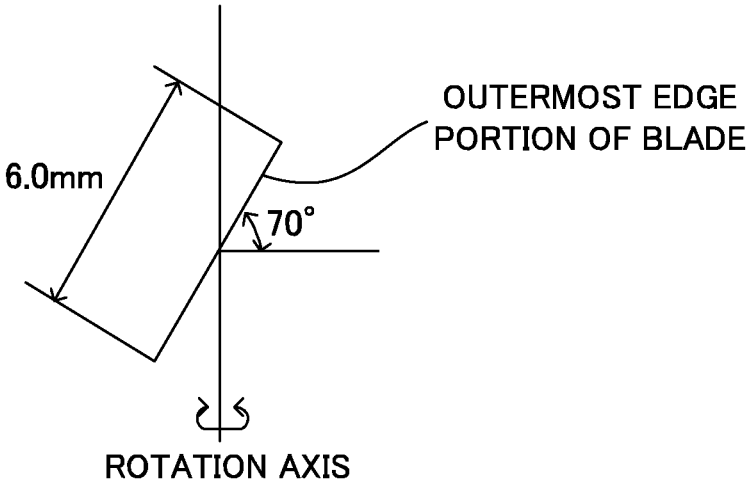

Specifically, the measurement is performed by the following operations. It should be noted that in all the operations, a 23.5-mm diameter blade dedicated for measurement with the FT-4 (See FIG. 3A. A rotation axis is present in a normal direction at the center of a blade plate measuring 23.5 mm by 6.0 mm. The blade plate is smoothly twisted counterclockwise so that both of its outermost edge portions (portions each distant from the rotation axis by about 11.5 mm) may each form an angle of 70° relative to a direction perpendicular to the rotation axis and its portions each distant from the rotation axis by 6 mm may each form an angle of 35° relative to the direction (see FIG. 3B), and the plate is made of SUS.) is used as the propeller-type blade.

First, 24 g of a toner that has been left to stand in an environment having a temperature of 23° C. and a humidity of 60% for 3 days is loaded into a container dedicated for measurement with the FT-4 (split container having a diameter of 25 mm and a volume of 25 mL (model number: C4031), height from the bottom surface of the container to its split portion: about 51 mm, hereinafter sometimes simply referred to as "container"), and is compressed to provide a toner powder layer.

In addition, a piston for a compression test (having a diameter of 24 mm and a height of 20 mm, and having mesh spread on its lower portion) is used in the compression of the toner instead of the propeller-type blade.

(1) Operation of Compressing Toner

8 Grams of the toner is loaded into the container dedicated for measurement with the FT-4. The compression piston dedicated for measurement with the FT-4 is attached to the container, and the compression is performed at 88 kPa for 60 seconds. 8 Grams of the toner is further loaded into the container, and a compression operation is similarly performed a total of three times to establish a state in which a total of 24 g of the toner in a consolidated state is present in the dedicated container.

(2) Split Operation

The toner above the toner powder layer is removed by slicing off the toner powder layer with the split portion of the container dedicated for measurement with the FT-4. Thus, a toner powder layer always having the same volume (25 mL) is formed.

(3) Measurement Operation (a) The blade is rotated at a peripheral speed (peripheral speed of each outermost edge portion of the blade) of 10 mm/sec in a rotation direction counterclockwise with respect to the surface of the toner powder layer (direction in which the powder layer is pushed into the container by the rotation of the blade). The speed at which the blade is entered into the toner powder layer in a vertical direction is set to such a speed that an angle formed between a path drawn by each outermost edge portion of the blade during its movement and the surface of the powder layer (hereinafter referred to as "blade path angle") becomes 5 (deg), and the propeller-type blade is entered up to a position having a height of 10 mm from the bottom surface of the toner powder layer.

In the measurement operation, the total sum of a rotational torque obtained when the blade is entered from the uppermost surface of the toner powder layer up to the position having a height of 10 mm from the bottom surface and a vertical load is defined as a total energy.

After that, the blade is rotated so as to have a peripheral speed of 60 mm/sec in a direction clockwise with respect to the surface of the powder layer (direction in which the powder layer is loosened by the rotation of the blade). The speed at which the blade is entered into the toner powder layer in the vertical direction is set to such a speed that the blade path angle becomes 2 (deg), and the blade is entered up to a position having a height of 1 mm from the bottom surface of the toner powder layer.

Further, the blade is pulled out by being moved up to a position having a height of 80 mm from the bottom surface of the powder layer at such a speed that the blade path angle becomes 5 (deg). After the completion of the pulling, the toner adhering to the blade is shaken down by rotating the blade clockwise and counterclockwise alternately to a small extent.

(b) The same operation as the operation (a) is repeated once (second blade-entering operation).

(c) The same operation as the operation (a) is repeated except that the blade is rotated at a peripheral speed of 20 mm/sec in the rotation direction counterclockwise with respect to the surface of the toner powder layer (third blade-entering operation).

(d) The same operation as the operation (a) is repeated except that the blade is rotated at a peripheral speed of 30 mm/sec in the rotation direction counterclockwise with respect to the surface of the toner powder layer (fourth blade-entering operation).

(e) The same operation as the operation (a) is repeated except that the blade is rotated at a peripheral speed of 50 mm/sec in the rotation direction counterclockwise with respect to the surface of the toner powder layer (fifth blade-entering operation).

The value measured at the time of the operation (e) was defined as the total energy of the toner.

<Methods of Quantitatively Determining Organic-Inorganic Composite Fine Particles, Strontium Titanate, and Other External Additive>

When the content of each external additive is measured in a toner obtained by externally adding a plurality of external additives to toner base particles, the external additives need to be removed from the toner base particles, and the plurality of kinds of external additives need to be isolated and recovered.

A specific method is, for example, the following method.

(1) 5 Grams of the toner is loaded into a sample bottle and 200 ml of methanol is loaded into the bottle.

(2) The external additives are separated by dispersing the sample with an ultrasonic washing machine for 5 minutes.

(3) The toner base particles and the external additives are separated from each other by suction filtration (10-μm membrane filter). Alternatively, in the case of a magnetic toner, only the supernatant may be separated by bringing a neodymium magnet into contact with the bottom of the sample bottle to fix magnetic toner base particles.

(4) The operations (2) and (3) are performed until a desired sample amount is obtained.

The externally added external additives are isolated from the toner base particles by the foregoing operations. The respective external additives are separated and recovered depending on their specific gravities by subjecting the recovered aqueous solution to a centrifuge. Next, the solvent is removed, the remainder is sufficiently dried with a vacuum dryer, and the mass of the dried product is measured. Thus, the content of each external additive can be obtained.

<Methods of Measuring Particle Diameters of Organic-Inorganic Composite Fine Particles, Strontium Titanate, and Other External Additive>

The number-average particle diameter of the primary particles of each of the organic-inorganic composite fine particles, strontium titanate, and the other external additive is measured with a scanning electron microscope "S-4800" (trade name; manufactured by Hitachi, Ltd.).

The toner to which the organic-inorganic composite fine particles, strontium titanate, and the other external additive have been externally added is observed, the long diameters of 100 primary particles of each of the organic-inorganic composite fine particles, strontium titanate, and the other external additive are randomly measured in a field of view magnified by a factor of up to 200,000, and their number-average particle diameter is determined.

An observation magnification is appropriately adjusted depending on the sizes of the organic-inorganic composite fine particles, strontium titanate, and the other external additive.

<Method of Measuring Shape Factor SF-2 of Organic-Inorganic Composite Fine Particles>

When a shape factor SF-2 of the organic-inorganic composite fine particles is measured, the external additives need to be removed from the toner base particles, and the plurality of kinds of external additives need to be isolated and recovered.

A specific method is, for example, the following method.

(1) 5 Grams of the toner is loaded into a sample bottle and 200 ml of methanol is loaded into the bottle.

(2) The external additives are separated by dispersing the sample with an ultrasonic washing machine for 5 minutes.

(3) The toner base particles and the external additives are separated from each other by suction filtration (10-μm membrane filter). Alternatively, in the case of a magnetic toner, only the supernatant may be separated by bringing a neodymium magnet into contact with the bottom of the sample bottle to fix magnetic toner base particles.

The externally added external additives are isolated from the toner base particles by the foregoing operations. The respective external additives are separated depending on their specific gravities by subjecting the recovered aqueous solution to a centrifuge. Thus, the organic-inorganic composite fine particles are recovered. The shape factor SF-2 of the organic-inorganic composite fine particles was calculated as described below by observing the organic-inorganic composite fine particles with a transmission electron microscope (TEM) "JEM-2800" (manufactured by JEOL Ltd.).

An observation magnification was appropriately adjusted depending on the sizes of the organic-inorganic composite fine particles, but the perimeters and areas of 100 primary particles were calculated with image processing software "Image-Pro Plus 5.1J" (manufactured by Media Cybernetics) in a field of view magnified by a factor of up to 200,000.

The shape factor SF-2 is calculated from the following equation, and the average of the calculated values is defined as the shape factor SF-2 of the organic-inorganic composite fine particles.

$$SF\text{-}2=(\text{perimeter of particle})^2/\text{area of particle}\times 100/4\pi$$

<Method of Measuring Weight-Average Particle Diameter (D4) of Toner>

The weight-average particle diameter (D4 ) of the toner was calculated by: performing measurement at a number of effective measurement channels of 25,000 using a precision particle size distribution measuring apparatus based on a pore electrical resistance method provided with a 100-μm aperture tube "Coulter Counter Multisizer 3" (trademark, manufactured by Beckman Coulter, Inc), and dedicated software included thereto "Beckman Coulter Multisizer 3 Version 3.51" (manufactured by Beckman Coulter, Inc) for setting measurement conditions and analyzing measurement data; and analyzing the measurement data.

An electrolyte aqueous solution prepared by dissolving special grade sodium chloride in ion-exchanged water to have a concentration of about 1 mass %, for example, "ISOTON II" (manufactured by Beckman Coulter, Inc) can be used in the measurement.

It should be noted that the dedicated software was set as described below prior to the measurement and the analysis. In the "change standard measurement method (SOM) screen" of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc) is set as a Kd value. A threshold and a noise level are automatically set by pressing a threshold/noise level measurement button. In addition, a current is set to 1,600 ρA, a gain is set to 2, and an electrolyte solution is set to ISOTON II, and a check mark is placed in a check box as to whether the aperture tube is flushed after the measurement.

In the "setting for conversion from pulse to particle diameter screen" of the dedicated software, a bin interval is set to a logarithmic particle diameter, the number of particle diameter bins is set to 256, and a particle diameter range is set to the range of from 2 μm to 60 μm.

A specific measurement method is as described below.

(1) About 200 ml of the electrolyte aqueous solution is charged into a 250-ml round-bottom beaker made of glass dedicated for Multisizer 3. The beaker is set in a sample stand, and the electrolyte aqueous solution in the beaker is stirred with a stirrer rod at 24 rotations/sec in a counter-clockwise direction. Then, dirt and bubbles in the aperture tube are removed by the "aperture flush" function of the analysis software.

(2) About 30 ml of the electrolyte aqueous solution is charged into a 100-ml flat-bottom beaker made of glass. About 0.3 ml of a diluted solution prepared by diluting "Contaminon N" (a 10 mass % aqueous solution of a neutral detergent for washing a precision measuring device formed of a nonionic surfactant, an anionic surfactant, and an organic builder and having a pH of 7, manufactured by Wako Pure Chemical Industries, Ltd.) with ion-exchanged water by three mass fold is added as a dispersant to the electrolyte aqueous solution.

(3) A predetermined amount of ion-exchanged water is charged into the water tank of an ultrasonic dispersing unit "Ultrasonic Dispersion System Tetora 150" (manufactured by Nikkaki Bios Co., Ltd.) in which two oscillators each having an oscillatory frequency of 50 kHz are built so as to be out of phase by 180° and which has an electrical output of 120 W. About 2 ml of the Contaminon N is charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte aqueous solution in the beaker may resonate to the fullest extent possible.

(5) About 10 mg of the toner is gradually added to and dispersed in the electrolyte aqueous solution in the beaker in the section (4) in a state in which the electrolyte aqueous solution is irradiated with an ultrasonic wave. Then, the ultrasonic dispersion treatment is continued for an additional 60 seconds. It should be noted that the temperature of water in the water tank is appropriately adjusted so as to be 10° C. or more and 40° C. or less upon ultrasonic dispersion.

(6) The electrolyte aqueous solution in the section (5) in which the toner has been dispersed is dropped with a pipette to the round-bottom beaker in the section (1) placed in the sample stand, and the concentration to be measured is adjusted to about 5%. Then, measurement is performed until the particle diameters of 50,000 particles are measured.

(7) The measurement data is analyzed with the dedicated software included with the apparatus, and the weight-average particle diameter (D4) is calculated. It should be noted that an "average diameter" on the analysis/volume statistics (arithmetic average) screen of the dedicated software when the dedicated software is set to show a graph in a vol % unit is the weight-average particle diameter (D4).

<Method of Measuring Average Circularity of Toner Base Particles>

The average circularity of toner base particles is measured under measurement and analysis conditions at the time of correction operation with a flow-type particle image analyzer "FPIA-3000" (manufactured by Sysmex Corporation).

A specific measurement method is as described below. First, about 20 ml of ion-exchanged water from which an impure solid and the like have been removed in advance is charged into a container made of glass. About 0.2 ml of a diluted solution prepared by diluting "Contaminon N" (a 10 mass % aqueous solution of a neutral detergent for washing a precision measuring unit formed of a nonionic surfactant, an anionic surfactant, and an organic builder and having a pH of 7, manufactured by Wako Pure Chemical Industries, Ltd.) with ion-exchanged water by about three mass fold is added as a dispersant to the container. Further, about 0.02 g of a measurement sample is added to the container, and then the mixture is subjected to a dispersion treatment with an ultrasonic dispersing unit for 2 minutes so that a dispersion liquid for measurement may be obtained. At that time, the dispersion liquid is appropriately cooled so as to have a temperature of 10° C. or more and 40° C. or less. A desktop ultrasonic cleaning and dispersing unit having an oscillatory frequency of 50 kHz and an electrical output of 150 W (such as "VS-150" (manufactured by VELVO-CLEAR)) is used as the ultrasonic dispersing unit. A predetermined amount of ion-exchanged water is charged into a water tank, and about 2 ml of the Contaminon N is added to the water tank.

The flow-type particle image analyzer mounted with "UPlanApro" (magnification: 10, numerical aperture: 0.40) as an objective lens was used in the measurement, and a particle sheath "PSE-900A" (manufactured by Sysmex Corporation) was used as a sheath liquid. The dispersion liquid prepared according to the procedure is introduced into the flow-type particle image analyzer, and 3,000 toner base particles are subjected to measurement according to the total count mode of an HPF measurement mode. Then, the average circularity of the toner base particles is determined with a binarization threshold at the time of particle analysis set to 85% and particle diameters to be analyzed limited to ones each corresponding to a circle-equivalent diameter of 2.954 μm or more and less than 39.69 μm.

On the measurement, automatic focusing is performed with standard latex particles (obtained by diluting, for example, "RESEARCH AND TEST PARTICLES Latex Microsphere Suspensions 5200A" manufactured by Duke Scientific with ion-exchanged water) prior to the initiation of the measurement. After that, focusing is preferably performed every two hours from the initiation of the measurement.

It should be noted that in Examples of the present application, a flow-type particle image analyzer which had been subjected to a calibration operation by Sysmex Corporation and received a calibration certificate issued by Sysmex Corporation was used. The measurement was performed under measurement and analysis conditions identical to those at the time of the reception of the calibration certificate except that particle diameters to be analyzed were limited to ones each corresponding to a circle-equivalent diameter of 2.954 μm or more and less than 39.69 μm.

Even after the external addition of an external additive, the measurement can be performed by the same approach.

<Method of measuring True Density of Toner Base Particles>

The true density of the toner base particles is measured with a dry automatic densimeter "AccuPyc 1330" manufactured by Shimadzu Corporation in accordance with the operation manual of the instrument.

<Methods of calculating Loading Density and Volume Ratio>

The toner loading density of a toner container is calculated by dividing the mass of the toner by the volume of the toner container.

Loading density=toner loading mass/volume of toner container

The ratio of the volume of the toner to the volume of the toner container is defined as a volume ratio, and is calculated as described below.

Volume ratio=toner loading mass/true density/volume of toner container×100

EXAMPLES

The present invention is hereinafter more specifically described by way of Examples, but the present invention is by no means limited thereto.

<Production Example of Binder Resin 1>

Bisphenol A ethylene oxide (2.2 mol adduct): 100.0 parts by mole

Terephthalic acid: 65.0 parts by mole

Trimellitic anhydride: 25.0 parts by mole

Acrylic acid: 10.0 parts by mole

80 Parts by mass of a mixture of the polyester monomers was loaded into a four-necked flask. The flask was mounted with a decompression apparatus, a water-separating apparatus, a nitrogen gas-introducing apparatus, a temperature-measuring apparatus, and a stirring apparatus, and the mixture was stirred under a nitrogen atmosphere at 160° C.

20 Parts by mass of vinyl-based monomers (90.0 parts by mole of styrene and 10.0 parts by mole of 2-ethylhexyl acrylate) constituting a StAc portion and 1 part by mass of benzoyl peroxide as a polymerization initiator were dropped from a dropping funnel to the mixture over 4 hours, and the whole was subjected to a reaction at 160° C. for 5 hours.

After that, the temperature in the flask was increased to 230° C., and 0.2 part by mass of dibutyltin oxide with respect to the total amount of the polyester monomer components was added to the resultant, followed by a condensation polymerization reaction for 6 hours. After the completion of the reaction, the resultant was removed from the container, cooled, and pulverized to provide a binder resin 1.

<Production Example of Binder Resin 2>

Bisphenol A ethylene oxide (2.2 mol adduct): 37.0 parts by mole

Bisphenol A propylene oxide (2.2 mol adduct): 67.0 parts by mole

Terephthalic acid: 77.0 parts by mole

The polyester monomers were loaded into an autoclave together with an esterification catalyst (dibutyltin oxide). The autoclave was mounted with a reflux condenser, a water-separating apparatus, a $N_2$ gas-introducing tube, a temperature gauge, and a stirring apparatus, and the mixture was subjected to a polycondensation reaction at 230° C. while a $N_2$ gas was introduced into the autoclave. After the completion of the reaction, a polyester resin was removed from the autoclave, cooled, and pulverized to provide a binder resin 2.

<Production Example of Toner Base Particles 1>

| | |
|---|---|
| Binder resin 1 | 60.0 parts by mass |
| Binder resin 2 | 40.0 parts by mass |
| Magnetic iron oxide particles (number-average particle diameter = 0.20 μm, Hc = 11.5 kA/m, σs = 88 $Am^2/kg$, σr = 14 $Am^2/kg$) | 60.0 parts by mass |
| Release agent (Fischer-Tropsch wax (manufactured by Sasol Limited, C105, melting point: 105° C.)) | 2.0 parts by mass |
| Charge control agent (T-77: manufactured by Hodogaya Chemical Co., Ltd.) | 2.0 parts by mass |

The materials were premixed with a Henschel mixer, and were then melted and kneaded with a biaxial kneading extruder.

The resultant kneaded product was cooled and coarsely pulverized with a hammer mill, and was then pulverized with a mechanical pulverizer (T-250 manufactured by Turbo Kogyo Co., Ltd.). The resultant finely pulverized powder was classified with a multi-division classifier utilizing the Coanda effect to provide negatively chargeable particles having a weight-average particle diameter (D4) of 7.0 μm.

The particles were subjected to a post-classification treatment with a surface-modifying apparatus Faculty (manufactured by Hosokawa Micron Corporation). At that time, the rotational peripheral speed of a dispersing rotor was set to 150 m/sec, the loading amount of a finely pulverized product was set to 7.6 kg per 1 cycle, and a surface modification time (=cycle time, a time period from the completion of the supply of the raw materials to the opening of a discharge valve) was set to 82 seconds. In addition, the temperature at the time of the discharge of the toner particles was 44° C. Toner base particles 1 having a weight-average particle diameter (D4) of 6.9 μm and an average circularity of 0.957 were obtained through the foregoing steps.

<Production Example of Toner Base Particles 2>

Toner base particles 2 having a weight-average particle diameter (D4) of 6.9 μm and an average circularity of 0.958 were obtained in the same manner as in the toner base particles 1 except that the amount of the magnetic material was changed to 95.0 parts by mass.

<Production Example of Toner Base Particles 3>

450 Parts by mass of a 0.1 mol/L Na $PO_4$ aqueous solution is supplied to 720 parts by mass of ion-exchanged water, and the mixture is heated to 60° C. After that, 67.7 parts by mass of a 1.0 mol/L $CaCl_2$ aqueous solution is added to the resultant to obtain an aqueous medium containing a dispersion stabilizer ($Ca_3(PO_4)_2$).

| | |
|---|---|
| Styrene | 74.00 parts by mass |
| n-Butyl acrylate | 26.00 parts by mass |
| Divinylbenzene | 0.52 part by mass |
| Iron complex of monoazo dye (T-77: manufactured by Hodogaya Chemical Co., Ltd.) | 1.00 part by mass |
| Hydrophobized magnetic material | 90.00 parts by mass |
| Amorphous polyester | 3.00 parts by mass |

(Saturated polyester resin obtained by a condensation reaction of an E.O. (ethylene oxide) adduct of bisphenol A and terephthalic acid; Mn=5,000, acid number=12 mgKOH/g, Tg=68° C.)

The above-mentioned components are uniformly dispersed and mixed through use of an attritor (manufactured by Mitsui Mining Co., Ltd.) to obtain a monomer composition. The monomer composition is heated to 60° C., and 15.0 parts by mass of a paraffin wax (endothermic peak top temperature: 77.2° C.) is mixed and dissolved in the monomer composition. Then, 4.5 parts by mass of a polymerization initiator 2,2'-azobis(2,4-dimethylvaleronitrile) is dissolved in the resultant.

The monomer composition is supplied to the aqueous medium, and the mixture is stirred at 12,000 rpm with CLEARMIX (manufactured by M Technique Co., Ltd.) at 60° C. in an atmosphere of $N_2$ for 15 minutes to granulate the mixture. Then, the resultant is heated to 70° C. at a rate of 0.5° C./min while stirring with a paddle stirring blade, and reacted for 5 hours while being kept at 70° C. After that, the resultant is increased in temperature to 90° C. and kept for 2 hours. After the completion of the reaction, the suspension was cooled, and $Ca_3(PO_4)_2$ was dissolved by adding hydrochloric acid thereto. The resultant was filtered, washed with water, and dried, whereby toner base particles 3 having a weight-average particle diameter (D4) of 8.0 μm and an average circularity of 0.979 were obtained.

TABLE 1

| | Addition amount of magnetic material (part(s) by mass) | True density (g/ml) | Weight-average particle diameter (μm) | Average circularity |
|---|---|---|---|---|
| Toner base particles 1 | 60 | 1.65 | 6.9 | 0.957 |
| Toner base particles 2 | 95 | 1.78 | 6.9 | 0.958 |

TABLE 1-continued

| | Addition amount of magnetic material (part(s) by mass) | True density (g/ml) | Weight-average particle diameter (μm) | Average circularity |
|---|---|---|---|---|
| Toner base particles 3 | 90 | 1.77 | 8.0 | 0.979 |

<Organic-Inorganic Composite Fine Particle>Production Examples 1 to 3

Organic-inorganic composite fine particles can be produced in accordance with the description of Examples of International Publication No. WO2013/063291.

Fine particles produced by using silica shown in Table 2 in accordance with Example 1 of International Publication No. WO2013/063291 were prepared as organic-inorganic composite fine particles to be used in Examples to be described later. The physical properties of organic-inorganic composite fine particles 1 to 3 are shown in Table 2.

TABLE 2

| | Particle diameter of colloidal silica (nm) | Number-average particle diameter (nm) | SF-2 |
|---|---|---|---|
| Organic-inorganic composite fine particles 1 | 25 | 106 | 116 |
| Organic-inorganic composite fine particles 2 | 15 | 62 | 104 |
| Organic-inorganic composite fine particles 3 | 25 | 335 | 106 |

<Strontium Titanate Production Example>

1,500 Grams of strontium carbonate and 800 g of titanium oxide were subjected to wet mixing in a ball mill for 8 hours, and were then filtered and dried. The mixture was molded at a pressure of 5 kg/cm$^2$, and was baked at 1,300° C. for 8 hours. The resultant was mechanically pulverized and classified to provide strontium titanate having a weight-average particle diameter of 2,000 nm. The particle diameter was controlled by changing conditions for the mechanical pulverization and the classification.

<Production Example of Toner 1>

1.0 Part by mass of the organic-inorganic composite fine particles 1, 0.6 part by mass of strontium titanate, and 0.8 part by mass of hydrophobic silica fine powder subjected to a surface treatment with hexamethyldisilazane (number-average particle diameter of primary particles: 10 nm) were added to 100.0 parts by mass of the toner base particles 1, and the contents were mixed with a Henschel mixer at 3,200 rpm for 2 minutes to provide a toner 1.

The number-average particle diameter of the organic-inorganic composite fine particles observed on the toner was the same as that measured for the organic-inorganic composite fine particles alone.

The physical properties of the toner 1 are shown in Table 3.

<Production Examples of Toners 2 to 11>

Toners 2 to 11 were each obtained in the same manner as in the toner 1 except that the kinds and addition amounts of the toner base particles and organic-inorganic composite fine particles to be used, and the addition amount of the hydrophobic silica fine powder were changed as shown in Table 3. The physical properties of the resultant toners 2 to 11 are shown in Table 3.

TABLE 3

| | Toner base particles | Organic-inorganic composite fine particles | | | Strontium titanate | | | Hydrophobic silica fine powder | | Toner physical properties | |
|---|---|---|---|---|---|---|---|---|---|---|---|
| | Toner base particles used | Organic-inorganic composite fine particles used | Addition amount (part(s) by mass) | Content (part(s) by mass) | Number-average particle diameter (nm) | Addition amount (part(s) by mass) | Content (part(s) by mass) | Addition amount (part(s) by mass) | Content (part(s) by mass) | Uniaxial collapse stress (kPa) | Total energy (mJ) |
| Toner 1 | 1 | 1 | 1.00 | 0.95 | 996 | 0.60 | 0.55 | 0.80 | 0.78 | 3.8 | 84.5 |
| Toner 2 | 1 | 2 | 0.60 | 0.52 | 986 | 0.60 | 0.58 | 0.80 | 0.74 | 3.1 | 87.3 |
| Toner 3 | 1 | 3 | 3.00 | 2.86 | 1,005 | 0.60 | 0.56 | 0.80 | 0.78 | 3.6 | 81.6 |
| Toner 4 | 1 | 1 | 1.00 | 0.94 | 488 | 0.60 | 0.57 | 0.80 | 0.76 | 3.2 | 85.6 |
| Toner 5 | 1 | 1 | 1.00 | 0.93 | 98 | 0.60 | 0.55 | 0.80 | 0.79 | 2.3 | 76.8 |
| Toner 6 | 1 | 1 | 0.30 | 0.28 | 1,036 | 0.60 | 0.58 | 0.80 | 0.78 | 2.1 | 91.6 |
| Toner 7 | 1 | 1 | 3.00 | 2.89 | 1,102 | 0.60 | 0.59 | 0.80 | 0.77 | 4.1 | 74.6 |
| Toner 8 | 1 | 1 | 4.00 | 3.79 | | — | | 0.80 | 0.77 | 2.2 | 72.6 |
| Toner 9 | 1 | | — | | 1,025 | 0.60 | 0.55 | 0.80 | 0.76 | 1.4 | 99.4 |
| Toner 10 | 3 | | — | | 986 | 0.60 | 0.53 | 0.80 | 0.79 | 1.5 | 64.4 |
| Toner 11 | 2 | | — | | 996 | 0.60 | 0.57 | 0.80 | 0.77 | 2.1 | 99.6 |

Example 1

The toner 1 was evaluated as described below. The results of the evaluations are shown in Table 4.

<Evaluation of Toner for Quality of Image Having High Print Percentage Under Low-Temperature and Low-Humidity Environment>

HP LaserJet Enterprise 600 M603dn (manufactured by Hewlett-Packard Company) was used. Its process speed was set to 375 mm/sec in order for the quality of an image having a high print percentage to be evaluated in an additionally strict manner.

1,300 Grams of the toner 1 was loaded into a predetermined process cartridge so that its loading density became 0.74 g/cm$^3$ while the cartridge was tapped. A volume ratio at this time was 42.5%. The process cartridge was left to stand under a low-temperature and low-humidity environment (15.0° C., 10% RH) for 24 hours, and then the evaluation was performed. An image output test in which a solid black image was continuously output on 10,000 sheets was performed. An image density on the 10,000th sheet was measured, and at the same time, the presence or absence of the occurrence of an image failure was confirmed. Specific evaluation criteria are described below.

A: No image failure is present.

B: Slight density unevenness occurs.

C: A streak occurs.

The image density was measured by measuring the reflection density of a 5-mm circular solid black image with a Macbeth densitometer (manufactured by GretagMacbeth) as a reflection densitometer and a SPI filter. A larger numerical value means that the developability is better. Specific evaluation criteria are described below.

A: 1.40 or more.

B: 1.30 or more and less than 1.40.

C: 1.20 or more and less than 1.30.

D: Less than 1.20.

Examples 2 to 8

Evaluations were performed in the same manner as in Example 1 except that the toners 2 to 8 were used. The results of the evaluations are shown in Table 4.

Example 9

First, 1,000 g of the toner 1 was loaded into a predetermined process cartridge so that its loading density became 1.16 g/cm$^3$ while the cartridge was tapped. After that, the process cartridge was left at rest for 6 hours, and then the remaining 1,000 g of the toner was loaded. A volume ratio at this time was 65.7%. Evaluations were performed in the same manner as in Example 1 except the foregoing. The results of the evaluations are shown in Table 4.

Comparative Example 1

700 Grams of the toner 9 was loaded into a predetermined process cartridge so that its loading density became 0.75 g/cm$^3$ while the cartridge was tapped. After that, the process cartridge was left at rest for 6 hours, and then the remaining 600 g of the toner was loaded. A volume ratio at this time was 42.5%. Evaluations were performed in the same manner as in Example 1 except the foregoing. The results of the evaluations are shown in Table 4.

Comparative Example 2

First, 700 g of the toner 10 was loaded into a predetermined process cartridge so that its loading density became 0.75 g/cm$^3$ while the cartridge was tapped. After that, the process cartridge was left at rest for 6 hours, and then the remaining 600 g of the toner was loaded. A volume ratio at this time was 42.5%. Evaluations were performed in the same manner as in Example 1 except the foregoing. The results of the evaluations are shown in Table 4.

Comparative Example 3

1,300 Grams of the toner 11 was loaded into a predetermined process cartridge so that its loading density became 0.74 g/cm$^3$ while the cartridge was tapped. A volume ratio at this time was 39.3%.

TABLE 4

| | Evaluated toner | Loading density (g/cm$^3$) | Volume ratio (%) | Image failure level | Reflection density |
|---|---|---|---|---|---|
| Example 1 | 1 | 0.74 | 42.5 | A | A (1.45) |
| Example 2 | 2 | 0.74 | 42.5 | A | A (1.42) |
| Example 3 | 3 | 0.74 | 42.5 | A | B (1.38) |
| Example 4 | 4 | 0.74 | 42.5 | A | A (1.43) |
| Example 5 | 5 | 0.74 | 42.5 | B | B (1.39) |
| Example 6 | 6 | 0.74 | 42.5 | B | B (1.36) |
| Example 7 | 7 | 0.74 | 42.5 | B | A (1.44) |
| Example 8 | 8 | 0.74 | 42.5 | B | B (1.36) |
| Example 9 | 1 | 1.16 | 65.7 | B | A (1.43) |
| Comparative Example 1 | 9 | 0.74 | 42.5 | C | C (1.21) |
| Comparative Example 2 | 10 | 0.74 | 42.5 | B | C (1.25) |
| Comparative Example 3 | 11 | 0.74 | 39.3 | C | B (1.36) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-161478, filed Aug. 7, 2014, which is hereby incorporated by reference herein in its entirety.

What is claimed is:

1. A process cartridge, which is detachably mountable to a main body of an image forming apparatus, the process cartridge comprising:

an electrostatic image-bearing member;

a charging member for charging the electrostatic image-bearing member;

a toner container;

a toner stored in the toner container, and a developing device for developing an electrostatic image formed on a surface of the electrostatic image-bearing member with the toner, wherein:

the toner container has arranged therein a member for stirring the toner;

the toner has a uniaxial collapse stress, at a time of a maximum consolidation stress of 10.0 kPa, of 2.0 kPa or more and 4.5 kPa or less, and the toner is stored in the toner container in a state in which the container has a loading density of 0.70 g/cm$^3$ or more; and in a test involving vertically entering a rotating blade, which is rotating at a peripheral speed of 50 mm/sec. and has a diameter of 23.5 mm, into a toner layer formed by compressing the toner without aeration, a total energy of the toner, which is a total sum of a rotational torque of the blade and a vertical load needed for vertically entering the blade, is 70 mJ or more and 95 mJ or less.

2. A process cartridge according to claim 1, wherein the toner comprises:

(i) toner base particles, and (ii) organic-inorganic composite fine particles and strontium titanate fine particles as external additives.

3. A process cartridge according to claim 2, wherein:

the organic-inorganic composite fine particles have a number-average particle diameter (D1) of primary particles of 50 nm or more and 500 nm or less; and the strontium titanate fine particles have a number-average particle diameter (D1) of primary particles of 500 nm or more and 2μm or less.

4. An image forming method comprising:

forming an electrostatic image on a charged electrostatic image-bearing member;

developing the electrostatic image with a toner to form a toner image;

transferring the toner image onto a transfer material through or not through an intermediate transfer member; and fixing the toner image on the transfer material with a fixing device, wherein:

the toner to be used in the development is stored in a toner container, and the toner container has a member for stirring the toner therein;

the toner has a uniaxial collapse stress, at a time of a maximum consolidation stress of 10.0 kPa, 2.0 kPa or more and 4.5 kPa or less, and the toner is stored in the toner container in a state in which the container has a loading density of 0.70 g/cm$^3$ or more; and in a test involving vertically entering a rotating blade, which is rotating at a peripheral speed of 50 mm/sec. and has a diameter of 23.5 mm, into a toner layer formed by compressing the toner without aeration, a total energy of the toner, which is a total sum of a rotational torque of the blade and a vertical load needed for vertically entering the blade, is 70 mJ or more and 95 mJ or less.

5. An image forming method according to claim 4, wherein the toner comprises:

(i) toner base particles, and (ii) organic-inorganic composite fine particles and strontium titanate fine particles as external additives.

6. An image forming method according to claim 5, wherein:

the organic-inorganic composite fine particles have a number-average particle diameter (D1) of primary particles of 50 nm or more and 500 nm or less; and the strontium titanate fine particles have a number-average particle diameter (D1) of primary particles of 500 nm or more and 2 μm or less.

7. A process cartridge according to claim 2, wherein the organic-inorganic composite fine particles have a structure in which inorganic fine particles are buried in a resin particle, and a plurality of protrusions derived from the inorganic fine particles are present on a surface of each of the organic-inorganic composite fine particles.

8. A process cartridge according to claim 3, wherein the organic-inorganic composite fine particles have a structure in which inorganic fine particles are buried in a resin particle, and a plurality of protrusions derived from the inorganic fine particles are present on a surface of each of the organic-inorganic composite fine particles.

9. An image forming method according to claim 5, wherein the organic-inorganic composite fine particles have a structure in which inorganic fine particles are buried in a resin particle, and a plurality of protrusions derived from the inorganic fine particles are present on a surface of each of the organic-inorganic composite fine particles.

10. An image forming method according to claim 6, wherein the organic-inorganic composite fine particles have a structure in which inorganic fine particles are buried in a resin particle, and a plurality of protrusions derived from the inorganic fine particles are present on a surface of each of the organic-inorganic composite fine particles.

* * * * *